United States Patent [19]

Metrier

[11] 4,009,531

[45] Mar. 1, 1977

[54] REVERSIBLE DIRECTION BUCKET WHEELS

[75] Inventor: Michel Metrier, Saint Cloud, France

[73] Assignee: Koch Transporttechnik GmbH, Germany

[22] Filed: Oct. 14, 1975

[21] Appl. No.: 622,414

[30] Foreign Application Priority Data

May 22, 1975 Germany ..... 2522562

[52] U.S. Cl. ..... 37/189; 37/94; 37/96; 198/508; 37/190

[51] Int. Cl.[2] ..... E02F 3/24

[58] Field of Search ..... 37/189, 190, 70, 91–96; 214/330, 507; 198/36, 110, 209

[56] References Cited

UNITED STATES PATENTS

| | | | |
|---|---|---|---|
| 416,769 | 12/1889 | Wiggin | 37/189 |
| 3,412,491 | 11/1968 | Raabe et al. | 37/189 |
| 3,520,573 | 7/1970 | Neinast | 37/189 X |

FOREIGN PATENTS OR APPLICATIONS

| | | | |
|---|---|---|---|
| 2,004,429 | 11/1969 | France | 37/190 |
| 754,818 | 5/1953 | Germany | 37/189 B |
| 21,144 | 5/1930 | Netherlands | 37/189 |
| 1,116,428 | 6/1968 | United Kingdom | 37/190 |
| 188,360 | 10/1966 | U.S.S.R. | 37/189 |

*Primary Examiner*—E. H. Eickholt
*Attorney, Agent, or Firm*—Laurence & Neilan

[57] ABSTRACT

The present invention relates to apparatus for handling bulk products, particularly in granular and pulverulent form, such as ores, coal or the like; the invention relates more especially to pick-up devices constituted by a plurality of buckets mounted on a mobile support such as a bucket wheel, bucket chain or the like.

4 Claims, 7 Drawing Figures

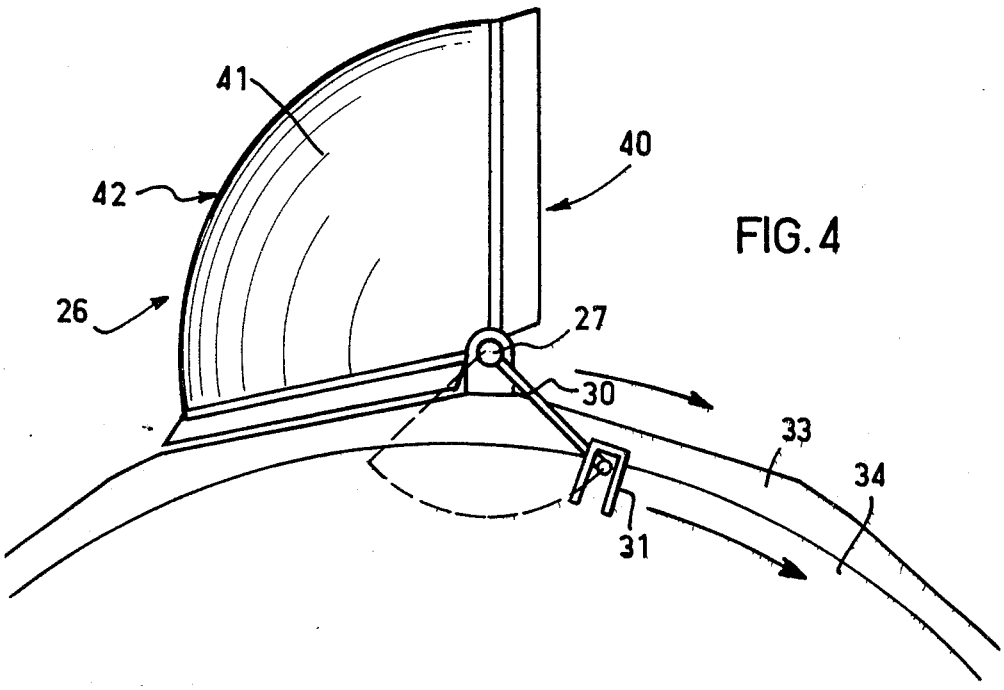
FIG. 4
FIG. 5
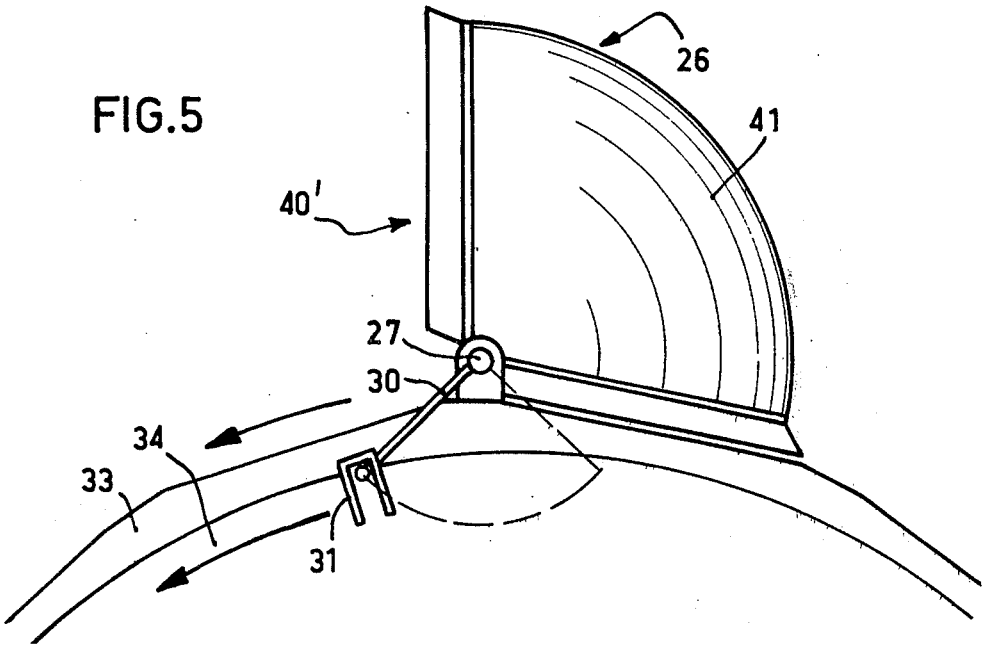

REVERSIBLE DIRECTION BUCKET WHEELS

In the presently known installations, the excavator wheels or bucket wheels are generally provided to cut into the heap to be picked up in one direction of rotation only, corresponding to the direction in which the opening of the buckets is facing the heap. Some embodiments comprise reversible buckets, but their use requires the manual intervention of one or more workmen when the buckets are to be reversed.

This arrangement, which is unidirectional (or reversible only by manual intervention thus taking a considerable time) limits the economy of operation of the existing installations, when the pick-up apparatus is of large dimensions, in which a wheel with several pick-up buckets sweeps along the whole length of a heap to be picked up; under these circumstances, the pick-up device starts at one end of the heap and sweeps over it by a succession of transverse journeys, removing a layer therefrom whose thickness corresponds substantially to the radius of the excavator wheel; however, once it has arrived at the end of the heap, the whole evacuation device (which is active in one direction only and not able to be turned round) must return backwards over the whole length of the heap up to its point of departure and then restart a new journey in order to remove a new layer; it is clear that the time required to return the excavator wheel from the terminal end of the heap to its initial end is lost time.

This lost time means on the one hand an unnecessary expenditure of energy for moving the device up to its point of departure, especially if the evacuation chain assembly (e.g. a conveyor belt), continues to function empty during this idle time.

Furthermore, the time taken for the support of the wheel to return to its point of departure is not productive; this drawback is all the more noticeable when the installation is used for unloading ore ships, barges or the like; in this case, the time taken by the bucket wheel to return slows down the unloading operation considerably and reduces the yield of the operation.

It is an object of the invention to remedy these various drawbacks and to produce an unloading installation such as an excavator wheel or bucket wheel that may pass over the heap or cargo to be picked up in two successive and opposite directions.

Under these conditions, the installation thus produced makes it possible to sweep over the heap to be picked up in one direction a top layer thereof being removed and evacuated and then to return rearwards, sweeping over the heap in the opposite direction to remove a lower layer without interruption nor idle time in the pick-up maneuver.

to this end, the present invention relates to an apparatus for picking up bulk products, particularly granular or pulverulent products from a heap, of the type constituted by a plurality of buckets mounted on an endless mobile support, such as a bucket chain or bucket wheel, wherein the mobile support comprises a driving device allowing said mobile support to be driven in two opposite directions, the mobile support comprises further a plurality of bucket assemblies, each bucket assembly being reversible and comprising a pivoting axis transverse with respect to the path of the mobile support, and a first and a second pick up openings, each opening being capable of being placed in a picking up and active position substantially perpendicular with respect to the path of the mobile support, whereas the other opening is then in inactive position, the pivoting of the reversible bucket assembly causing one bucket opening previously in active position to be placed in inactive position, whereas the other bucket opening previously in inactive position is moved to occupy its active and pick up position, each bucket opening, when put in active position, facing a direction opposite to the direction faced by the other bucket opening when in active position, thus permitting the mobile support to be moved alternatively in two opposite directions each of which corresponds to one of the bucket opening being placed in active picking up position, so as to face the heap, the reversible bucket assemblies comprising further means to cause said bucket assemblies automatically to be pivoted when the direction of the mobile support path is turned by 180°.

The device according to this invention may attack the pick-up face in two opposite directions; in each of these directions, a pick-up opening cuts into the heap and the corresponding bucket, whose opening faces the heap receives the picked up material in its bottom until it is tipped out, for instance on a belt conveyor for its evacuation.

The invention will be more readily understood from the following description with reference to the accompanying drawings in which:

FIG. 4 is a schematic view of a bucket assembly according to a variant.

FIG. 5 is the same view as FIG. 4, but showing the bucket assembly in the opposite direction compared with FIG. 4.

Figure 1:
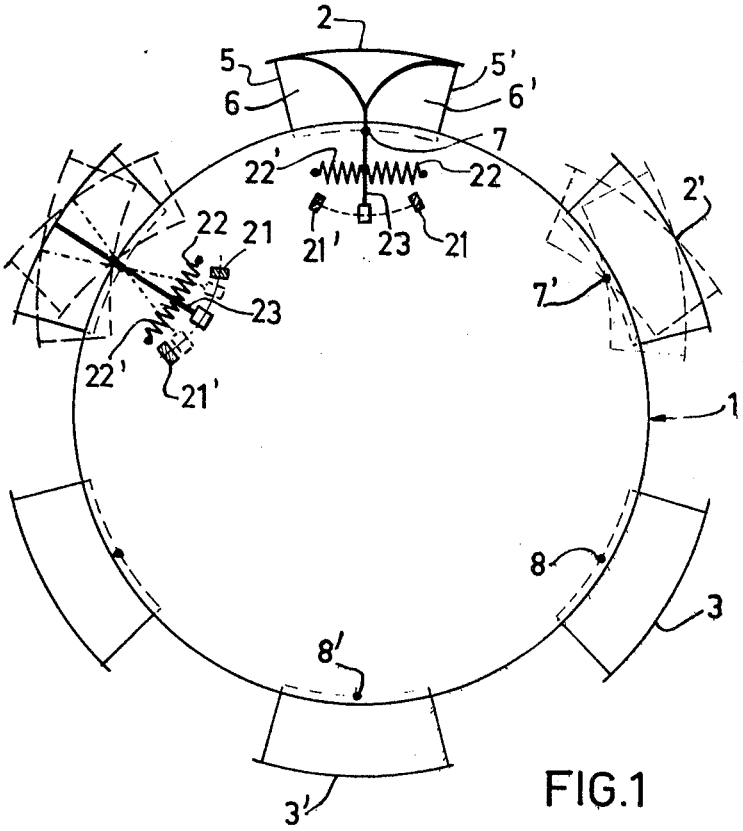
FIG. 1 shows a general view of an excavator wheel comprising buckets according to the invention, these buckets being in central position along their pivoting axis, i.e. in rest position.

Referring now to the drawings, FIG. 1 schematically shows the excavator wheel or bucket wheel; on the chassis of the wheel 1 are mounted six bucket assemblies 2, 2',3, 3', etc... The internal structure of each bucket assembly is shown on bucket 2; each bucket assembly comprises two pick-up openings 5, 5' disposed transversely with respect to the plane of the drawing, i.e. with respect to the plane of rotation of the wheel 1; under these conditions, the wheel may equally well rotate in either direction, i.e. in clockwise or anti-clockwise direction; either one of openings 5 or 5' will face the heap so that the double bucket can function whatever the direction of rotation of the wheel; with each pick-up opening 5 or 5' there is associated a bucket bottom 6 or 6' which receives the material taken up from the heap and which subsequently tips it out to the center of the wheel where the material in received on a belt conveyor 24 to be evacuated.

According to the invention, each bucket is constituted by a structure where the bucket assembly with two openings is mounted on a chassis articulated on a shaft 7, 7', 8, 8' disposed transversely with respect to the plane of rotation of the wheel 1; each double bucket assembly 2, 2' etc... may therefore pivot around this axis of rotation and occupy the two end positions shown in dotted lines for bucket 2'; each of these positions corresponds to a larger opening given to one of the pick-up openings whilst the opposite opening is in concealed or inactive position.

Under these conditions, depending upon its position, the double bucket assembly presents one opening in active position that may pick up the bulk material from the heap, whilst the opposite opening is partly concealed and in inactive position.

Each opening of the bucket assembly is placed into active or inactive position automatically and without maneuvering by the personnel; mounted to pivot on its axis 7, 7', 8, 8' is limited in its movement by stops 21, 21', on which the bucket assembly abuts through the arm 23 when it arrives in either of its two end positions, each corresponding to one opening being in active position. These stop members act as buffers and so avoid a premature wear of the buckets in the event of an abrupt reversal from one end position to another; furthermore the springs 22, 22', act as return members and tend to return each bucket into a central position (as shown for the buckets of FIG. 1) which forms an intermediate between the two end positions. They also ensure a noiseless pivoting of the buckets to their active position and form a dampening system.

When the wheel rotates the buckets meet the heap and the resistance of the products automatically brings the bucket into active position, i.e. the pick-up opening facing the heap is open to a maximum.

Figure 2:
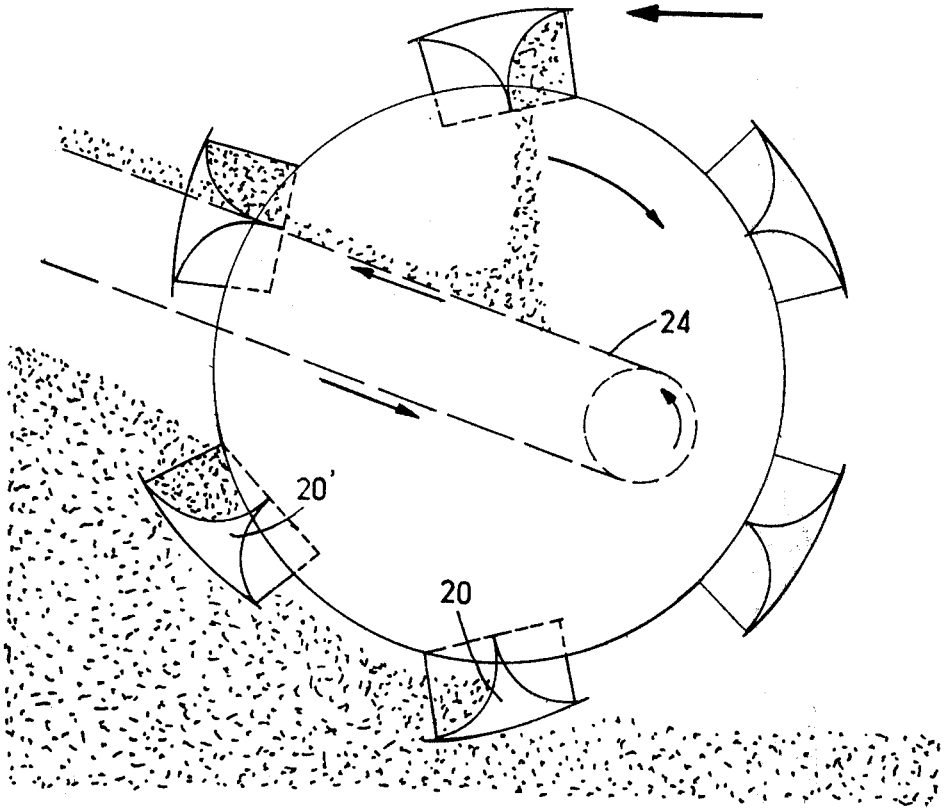
FIG. 2 shows the same wheel cutting into the pick-up face from right to left, rotating in clockwise direction.
Figure 3:
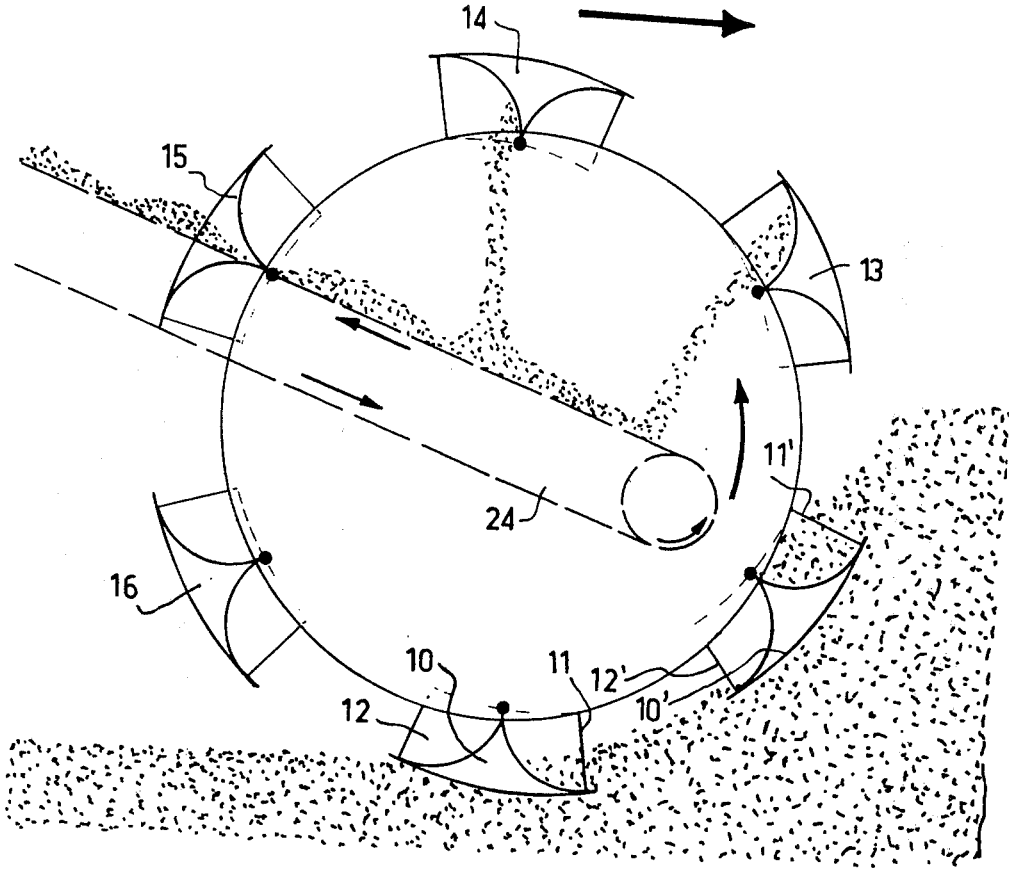
FIG. 3 shows the same wheel after reversal, cutting into the same heap in the opposite direction, rotating in anti-clockwise direction.

This operation is seen in FIGS. 2 and 3; buckets assemblies 10 and 10' (FIG. 3), on meeting the heap, pivot into their position corresponding to the enlarging of opening 11, 11' and to the concealing of the opposite opening 12, 12'; this pivoting is effected against the action of the springs 22 and 22'.

Downstream of the pick-up position, the loaded buckets remain in active position under the weight of the material that they contain and, under these conditions, buckets 13, 14 and 15 are in the same position as the buckets 10 and 10' cutting into the heap.

Having arrived in high position, the bucket 15 pours its contents into the wheel, in known manner, and the products are taken from the center of the wheel by a handling device such as a belt conveyor 24; in the subsequent positions, the buckets 16, etc. are returned by the action of the springs 22, 22', into a central and substantially balanced position between the two end positions until they meet the heap, the resistance of which will return them into active position, as is seen for bucket 10.

The wheel having arrived at the end of the heap may change both the direction of rotation and direction of sweeping the heap, to follow the directions as indicated in FIG. 2, and the wheel will cover the same path in the reverse direction by rotating in the opposite direction and cutting into a lower layer.

The buckets do not undergo any modification and, when meeting the heap in the opposite direction, the buckets 20, 20' will automatically be placed in active position by the resistance of the heap.

Figure 6:
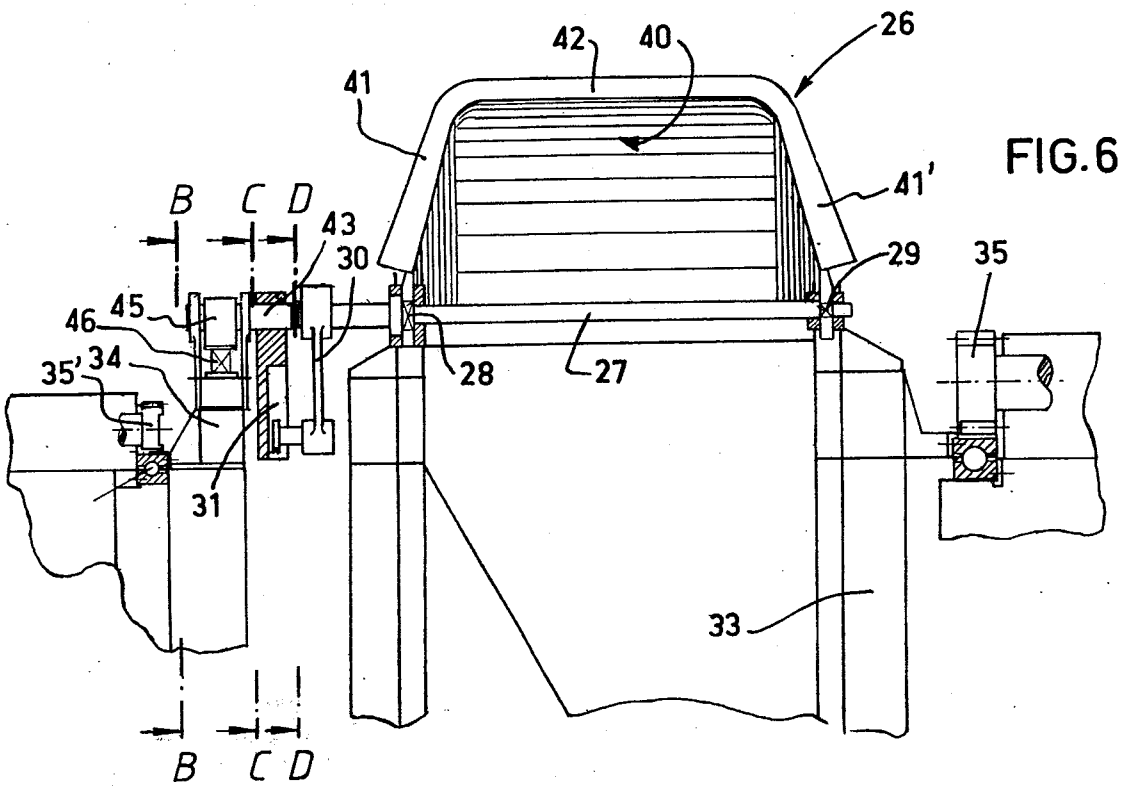
FIG. 6 is a transverse section view of a more detailed embodiment of a bucket assembly according to the variant schematically shown in FIGS. 4 and 5.
Figure 7:
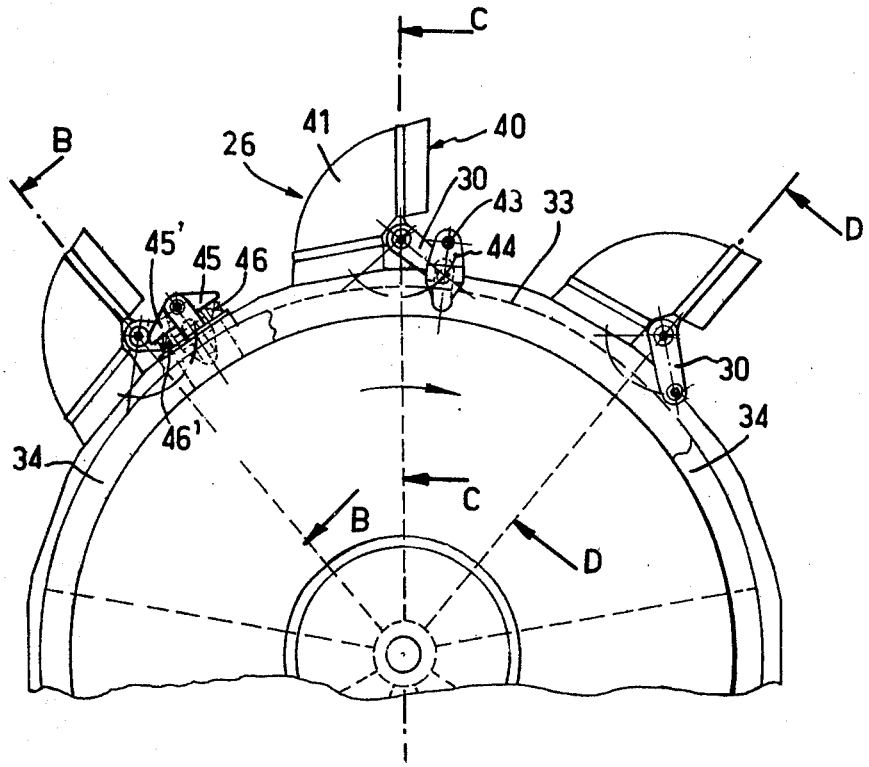
FIG. 7 is a partial side view of a bucket wheel according to the embodiment shown in FIG. 6.

The embodiment shown in the schematic views of FIGS. 4 and 5 and in the more detailed views of FIGS. 6 and 7, is a variant where the bucket assembly 26 is pivotally mounted on the axis 27 rotating in the roller bearings 28 and 29.

In the variant the bucket assembly is in the form of a sector of a cylinder and substantially in the form of a quarter of a cylinder; it comprises two sides 41, 41' in the form of a quarter of a circumference and a curved bottom 42 integral with said sides; the pivoting axis 27, connected to the bucket assembly at the vertex of the angle formed by the lateral sides in form of sector, is connected to a pivoting arm 30 whose end opposite the axis 27 is inserted in the fork member 31 mounted on an auxiliary support 34 in the form of a ring coaxial with the mobile support of the buckets, i.e. with the bucket wheel 33.

Said wheel 33 on which the bucket assemblies are pivotally mounted is driven through gear 35 by the general driving system of the apparatus which also drives the auxiliary ring 34 through the gear 35' in the same direction with respect to the wheel 33 but at a slightly higher speed.

Accordingly when the direction of rotation of the wheel 33 is reversed, the direction of rotation of auxiliary ring 34 is also reversed and due to the difference of speed between the auxiliary ring 34 and the wheel 33, the ring 34 is caused to overtake the wheel and the fork member 31 is caused to overtake the corresponding bucket assembly position in the direction of rotation of the wheel 33 and to draw the arm 30 towards the direction of rotation of the wheel 33, thus placing and maintaining the bucket assembly in proper active position so that the proper bucket opening 40, 40' will face forwardly with respect to the direction of the bucket wheel.

A friction device (not shown) permits the auxiliary ring 34 to be driven at the same speed with respect to the bucket wheel 33 when the ring 34 has taken its maximum of advance after a direction reversal, i.e. when the arm 30 has been pivoted; this friction device ensures that the arm 30 is constantly drawn forwardly, thus applying the bucket assembly in active position against the wheel 33.

The fork member 31 is associated with a dampening device and to this effect said fork member is articulated in 43 on an upright support 44 mounted on the auxiliary ring 34 and is secured to two lateral arms 45, 45' each resting on lateral elastic buffers or dampers 46, 46'. The transmission of the actuation from the auxiliary ring 34 to be pivoting arm 30 through the fork member 31 is dampened, the fork member being capable of a limited pivoting movement against the elastic buffers 46, 46'.

What I claim is:

1. An apparatus for picking up bulk products, particularly granular or pulverulent products from a heap, of the type constituted by a plurality of buckets mounted on an endless mobile support, such as a bucket wheel, wherein the mobile support comprises a driving device allowing said mobile support to be driven in two opposite directions, each bucket comprising a pivot means having a pivoting axis transverse with respect to the path of the mobile support, and means defining first and second pick up openings, each opening means being capable of being placed in a picking up and active position substantially perpendicular with respect to the path of the mobile support, and facing a direction opposite to the direction faced by the other bucket opening means when in active position, thus permitting the mobile support to be moved alternatively in two opposite directions each of which corresponds to one of the opening means of the buckets being placed in active picking up position, so as to face the heap, each bucket comprising further means to cause said bucket automatically to be pivoted when the direction of the mobile support path is turned by 180°;

said means being constituted by:

a plurality of pivoting arms, each arm being connected to one pivot means on one bucket;

a plurality of actuation members, each member being adapted to move one of said arms so as to cause the corresponding bucket to be pivoted;

a common auxiliary support on which said actuation members are mounted, said auxiliary support being driven by the driving device of the apparatus, and in the same direction with respect to the direction of the mobile support of the buckets, the displacement of said auxiliary support compared with said mobile support of the buckets causing the pivoting arms to be angularly moved and the bucket to be pivoted, so as to place one bucket opening in active position facing the heap towards which the mobile support is moved.

2. An apparatus as claimed in claim 1, wherein said auxiliary support is connected through driving gears to the general driving system of the mobile support of the buckets, so as to be moved in the same direction and at a slightly higher speed with respect to the mobile support, the auxiliary support causing the actuating members to draw the pivoting arms of the buckets forwardly compared with the direction of the mobile support, whereby the buckets are automatically placed in the proper position, one of the two bucket opening means facing the direction of the path of the mobile support and being maintained in this position as long as the mobile support is following the same direction.

3. An apparatus as claimed in claim 1, wherein the actuation member is in the form of a fork, the end of the pivoting arm being inserted between the prongs of said fork, and said actuation member is connected to said auxiliary support through dampening means.

4. An apparatus as claimed in claim 1, wherein the actuation member is articulated to an upright support mounted on the auxiliary support and is secured to two lateral arms each resting on lateral elastic buffers, adapted to dampen the pivoting movement of the actuation member and to return said actuation member in its median position.

* * * * *